US007891300B2

(12) United States Patent
Pabst et al.

(10) Patent No.: US 7,891,300 B2
(45) Date of Patent: Feb. 22, 2011

(54) CABLE DERAILING PREVENTION DEVICE FOR CARRIER/TRACTION CABLES OF CABLE CAR SYSTEMS

(75) Inventors: Otto Pabst, Rio Pusteria (IT); Nikolaus Erharter, San Candido (IT); Gunther Steger, Vipiteno (IT)

(73) Assignee: High Technology Investments B.V., Leimuiden (NL)

( * ) Notice: Subject to any disclaimer, the term of this patent is extended or adjusted under 35 U.S.C. 154(b) by 18 days.

(21) Appl. No.: 12/088,540

(22) PCT Filed: Sep. 13, 2006

(86) PCT No.: PCT/IB2006/002512

§ 371 (c)(1),
(2), (4) Date: Sep. 29, 2008

(87) PCT Pub. No.: WO2007/036776

PCT Pub. Date: Apr. 5, 2007

(65) Prior Publication Data

US 2009/0165666 A1 Jul. 2, 2009

(30) Foreign Application Priority Data

Sep. 29, 2005 (IT) ..... BZ2005A0051

(51) Int. Cl.
*B61B 12/02* (2006.01)
*B61B 12/06* (2006.01)

(52) U.S. Cl. ..... 104/178; 104/173.2; 104/179; 104/117.1

(58) Field of Classification Search ..... 104/112, 104/115, 173.1, 173.2, 198, 199, 184–186, 104/188, 189; 105/151
See application file for complete search history.

(56) References Cited

U.S. PATENT DOCUMENTS

| | | | |
|---|---|---|---|
| 472,211 | A | 4/1892 | Fralinger |
| 1,944,446 | A | 1/1934 | McGowen |
| 2,662,587 | A | 12/1953 | McIlvaine |
| 2,710,650 | A | 6/1955 | Sowder |
| 2,985,224 | A | 5/1961 | Sowder |
| 3,170,412 | A | 2/1965 | Sowder |

(Continued)

FOREIGN PATENT DOCUMENTS

| | | |
|---|---|---|
| AT | 315 910 | 6/1974 |

(Continued)

*Primary Examiner*—S. Joseph Morano
*Assistant Examiner*—Zachary Kuhfuss
(74) *Attorney, Agent, or Firm*—K&L Gates LLP

(57) ABSTRACT

The invention relates to a cable derailing prevention device for carrier/traction cables of cable car systems in an installation including: a carrier/traction cable; a multitude of rollers which flank a coupling rail and are located at the exit from the station; a multitude of clamps from which the driving means are suspended; at least one roller that has a couple and clamp and supports the cable, and a support roller or hold-down roller battery according to the cable guide, the coupling rail forming a coupling area between the cable and the clamps. According to the invention, an aligning device is mounted in front of the coupling area of the clamps on the cable before the coupling rail and limits the deviation of the cable due to a derailing on the roller battery so that the cable is always located inside the opening of the clamp.

12 Claims, 6 Drawing Sheets

U.S. PATENT DOCUMENTS

| | | | | |
|---|---|---|---|---|
| 3,934,517 | A | 1/1976 | Hirsig | |
| 4,185,562 | A | 1/1980 | Hatori et al. | |
| 4,226,187 | A | 10/1980 | Paulsen et al. | |
| 4,269,123 | A | 5/1981 | Segafredo | |
| 4,280,411 | A | 7/1981 | Katayose et al. | |
| 4,462,314 | A | 7/1984 | Kunczynski | |
| 4,470,355 | A | 9/1984 | Kunczynski | |
| 4,473,011 | A | 9/1984 | Wuschek | |
| 4,640,197 | A | 2/1987 | Brian | |
| 4,641,587 | A | 2/1987 | Dalliard | |
| 4,671,187 | A | 6/1987 | Kunczynski | |
| 4,833,997 | A | 5/1989 | Cathiard | |
| 4,898,100 | A | 2/1990 | Brochand | |
| 5,107,771 | A | 4/1992 | Kainz | |
| 5,113,768 | A | 5/1992 | Brown | |
| 5,226,368 | A * | 7/1993 | Brochand et al. | 104/179 |
| 5,515,789 | A | 5/1996 | Brochand et al. | |
| 5,562,040 | A | 10/1996 | Egli | |
| 5,582,109 | A | 12/1996 | Levi et al. | |
| 5,595,122 | A | 1/1997 | Levi et al. | |
| 6,036,282 | A | 3/2000 | Clarke et al. | |
| 6,345,578 | B1 | 2/2002 | Pabst | |
| 6,543,366 | B2 | 4/2003 | Pabst et al. | |
| 6,585,232 | B2 | 7/2003 | Rechenmacher | |
| 7,410,068 | B1 | 8/2008 | Andreetto | |
| 7,549,377 | B2 | 6/2009 | Pabst | |
| 2002/0026839 | A1 | 3/2002 | Lehtovaara | |
| 2002/0088368 | A1 | 7/2002 | Pabst et al. | |
| 2006/0249718 | A1 | 11/2006 | Levi | |
| 2007/0169660 | A1 | 7/2007 | Pabst | |
| 2008/0115689 | A1 | 5/2008 | Heil et al. | |
| 2009/0165666 | A1 | 7/2009 | Pabst et al. | |
| 2009/0165668 | A1 | 7/2009 | Andreetto | |

FOREIGN PATENT DOCUMENTS

| | | | |
|---|---|---|---|
| AT | 342 655 | | 4/1978 |
| AT | 373 832 | | 2/1984 |
| AT | 388 146 | | 5/1989 |
| AT | 390 926 | | 7/1990 |
| CH | 259 291 | | 1/1949 |
| CH | 360 704 | | 4/1962 |
| CH | 554761 | | 10/1974 |
| DE | 423865 | | 1/1926 |
| DE | 2020746 | | 12/1971 |
| DE | 2101743 | | 9/1972 |
| DE | 3109294 | | 10/1982 |
| DE | 3834116 | | 5/1989 |
| DE | 3927757 | | 3/1991 |
| DE | 4127373 | | 2/1993 |
| EP | 0055955 | | 7/1982 |
| EP | 0135239 | | 3/1985 |
| EP | 0 218 306 | | 4/1987 |
| EP | 0 218 897 | | 4/1987 |
| EP | 0281205 | | 9/1988 |
| EP | 0491632 | | 6/1992 |
| EP | 0 613 807 | | 11/1992 |
| EP | 0 517 622 | | 12/1992 |
| EP | 0 745 526 | | 12/1992 |
| EP | 0640518 | | 3/1995 |
| EP | 0678433 | | 10/1995 |
| EP | 0687607 | | 12/1995 |
| EP | 0692418 | | 1/1996 |
| EP | 0 970 864 | | 1/2000 |
| EP | 1077167 | | 2/2001 |
| EP | 1088729 | | 4/2001 |
| EP | 1174323 | | 1/2002 |
| EP | 1195305 | | 4/2002 |
| EP | 1209055 | | 5/2002 |
| EP | 1331151 | | 7/2003 |
| EP | 1 364 853 | | 11/2003 |
| EP | 1419950 | | 5/2004 |
| FR | 891743 | | 3/1944 |
| FR | 913146 | | 8/1946 |
| FR | 1100001 | | 9/1955 |
| FR | 1 199 721 | | 12/1959 |
| FR | 1 423 648 | | 1/1966 |
| FR | 2340895 | | 9/1977 |
| FR | 2 387 830 | | 11/1978 |
| FR | 2 391 450 | | 12/1978 |
| FR | 2 392 858 | | 12/1978 |
| FR | 2 562 857 | | 10/1985 |
| FR | 2644740 | A1 * | 9/1990 |
| FR | 2 670 452 | | 6/1992 |
| FR | 2706404 | | 12/1994 |
| FR | 2 823 482 | | 10/2002 |
| FR | 2867142 | | 9/2005 |
| GB | 1326264 | | 8/1973 |
| GB | 1 353 030 | | 5/1974 |
| GB | 1460106 | | 12/1976 |
| GB | 2017024 | | 9/1979 |
| WO | 2004/067347 | | 8/2004 |
| WO | WO2004067347 | | 8/2004 |
| WO | 2004/085221 | | 10/2004 |
| WO | 2005/032901 | | 4/2005 |
| WO | WO2008020021 | | 2/2008 |
| WO | WO2008129017 | | 10/2008 |
| WO | WO2008129019 | | 10/2008 |
| WO | WO2009019259 | | 2/2009 |
| WO | WO2009053485 | | 4/2009 |

* cited by examiner

CABLE DERAILING PREVENTION DEVICE FOR CARRIER/TRACTION CABLES OF CABLE CAR SYSTEMS

PRIORITY CLAIM

This application is a national stage application of PCT/IB2006/002512, filed Sep. 13, 2006, which claims the benefit of priority of Italian Application No. BZ2005A000051, filed Sep. 29, 2005, the entire contents of which are incorporated herein.

TECHNICAL FIELD OF THE INVENTION

The present invention relates to a cable derailing prevention device for carrier/traction cables of cable car systems.

At the exit of stations of cable car systems there is a risk of the clamp to which the driving means is suspended becoming uncoupled from the cable if the cable is derailed following the clamping area. Depending on whether the roller battery acts holding down or supporting, the cable can be deflected upwards or downwards to be captured by a cable capturing means whilst simultaneously leaving its predevised position or clamping area at the exit of the station.

BACKGROUND OF THE INVENTION

Known from the international patent application WO 2004/085221 is a device for capturing a traction rope of an aerial ropeway or a T bar, which has become derailed from the rope-bearing rollers of a support. The traction rope includes at least one rope capturing device which is displaceably arranged in the region of the rope-bearing rollers, a notification device for switching off the aerial ropeway or the T bar when a critical rope situation has been exceeded. The rope capturing device can be displaced from the stowed rest position to a rope capturing position when a predetermined critical rope situation is exceeded.

The device as described is, however, incapable of reliably solving the pertinent problem involved because the run of the rope or cable is restricted within certain limits permitting capture of the cable by the clamp. In addition to this, the device as described is devised to capture a cable already clamped by the clamp to halt the system via a notification or alert device when the cable is derailed.

SUMMARY OF THE INVENTION

The object of the present invention is to avoid the problems associated with known prior art and to propose a cable derailing prevention device at the exit of a station which now assures positioning of the cable and capture of the cable by the clamp in the clamping area and halting the system with the clamps still coupled when derailing occurs.

A further object is to assign the cable derailing prevention device a forced guidance means such that cable capture by the clamp is forced.

These and further objects are achieved by a cable derailing prevention device in cable car systems which include a carrier/traction cable, a multitude of clamps from which a driving means is suspended, a multitude of rollers which flank a coupling rail and are located at an exit from a station, wherein the coupling rail forms a coupling area between the cable and the clamps, at least one roller that has a couple and a clamp and supports the cable, a support roller or hold-down roller battery according to the cable guide, and an aligning device mounted in front of the coupling area of the clamps on the cable before the coupling rail, wherein the aligning device limits the deviation of the cable due to a derailing on the roller battery so that the cable is always located inside a jaw opening of the clamp.

By proposing a means for aligning the cable before the coupling area of an automatic coupling clamp, the cable is now guided in its running direction so as to arrive at the first roller battery centered on the rollers to lay the cable between the aligning means and the first roller battery such that it is located within the limits imposed by the jaw opening of the clamp to be coupled.

In one embodiment for an even better alignment of the cable in the direction of the opening of the clamping jaw, there is provided at least one guiding support between the coupling area of the clamp and the roller battery. In this embodiment, the at least one guiding support invites the cable to proceed in the direction of the line as needed for coupling.

In another embodiment there is provided in addition to this support an upper shoe—type cable capture device to maintain the cable in a line suitable to center the cable on the jaw opening of the clamp to be coupled.

In another embodiment, instead of a simpler support for guidance, a forced guidance means is provided which forces the clamp to move above the cable, such as when there is a snow accumulation on the guide rail of the roller carrying the clamp.

BRIEF DESCRIPTION OF THE DRAWINGS

Further features and details read from the dependent claims and the following description of a preferred embodiment as shown in the drawing in which:

DETAILED DESCRIPTION OF THE INVENTION

Figure 1:
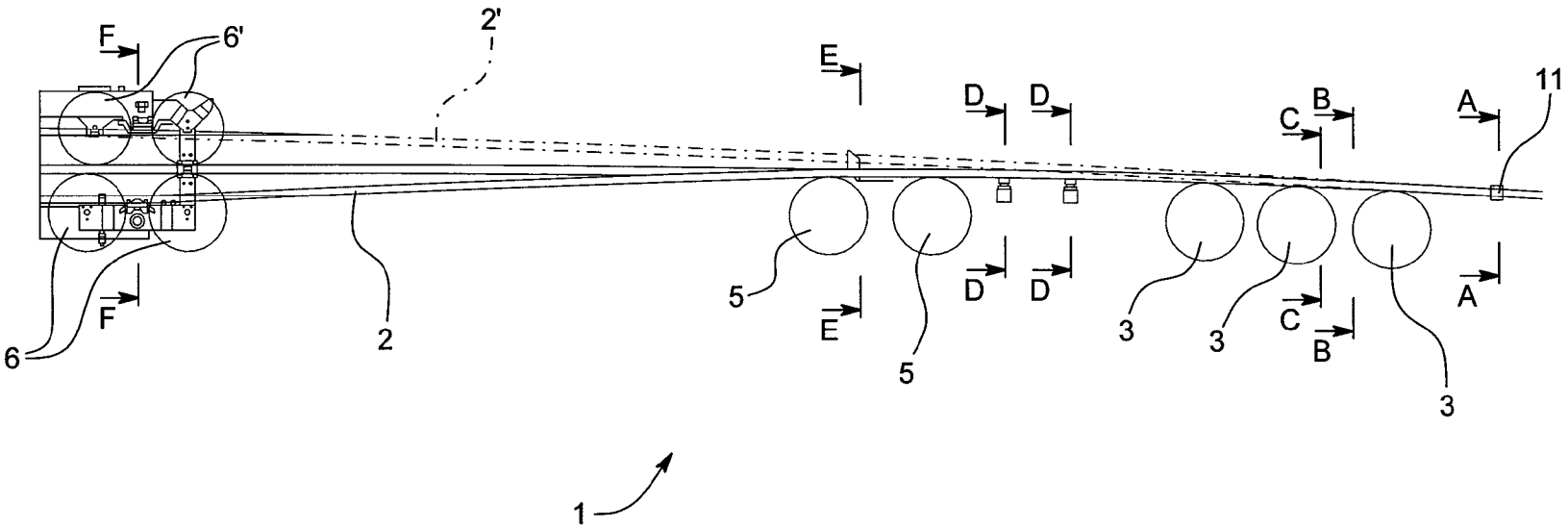
FIG. 1 is a diagrammatic vertical section view through one embodiment of a cable car system showing the carrier/traction cable at the exit from a station.

Referring now to FIG. 1 there is illustrated in the region of the station exit a cable car system identified in all by the reference numeral 1.

By known ways and means the system comprises a carrier/traction cable 2 (or 2' shown in phantom), a multitude of rollers 3 at the exit of the station which flank a coupling rail of a known kind (not shown), a clamp 4 to which the driving means (not shown) are attached and at least one roller 5 supporting the cable 2 with a coupled clamp 4 and a supporting or hold-down roller battery 6 according to the run of the cable 2.

Figure 7:
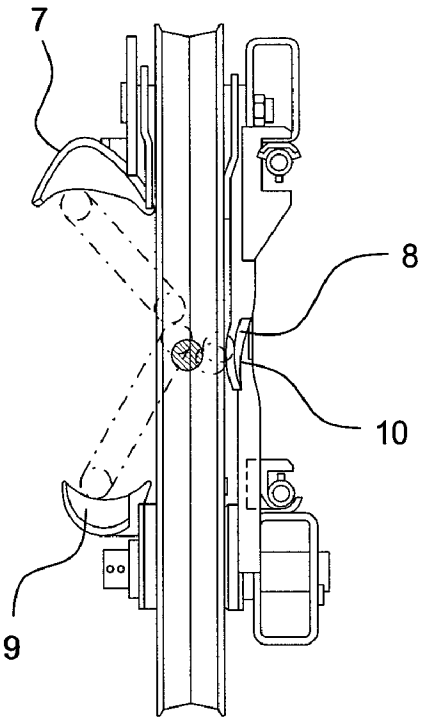
FIG. 7 is a sectional view taken along the line F-F of the embodiment shown in FIG. 1.

Referring now to FIG. 7, there is illustrated how the roller battery 6 is provided with an upper, outer cable capture shoe 7 and an inner, upper guard 8 when the support of the roller battery 6 acts as a hold-down support in which the cable is urged from below on the roller battery 6', whereas the roller battery 6 is provided with a lower, outer cable capture shoe 9 and a lower, inner guard 10 when the support of the roller battery 6 acts as a carrying support in which the cable is urged from above on the roller battery 6. In the situation as described, any derailing at the roller battery 6 could already cause an excessive deflection of the cable in the coupling area in which the clamp 4 is still incapable of capturing the cable 2 because the opening of its jaw is unable to capture the cable with the subsequent risk of the cable driving means dropping out of place.

Figure 2:
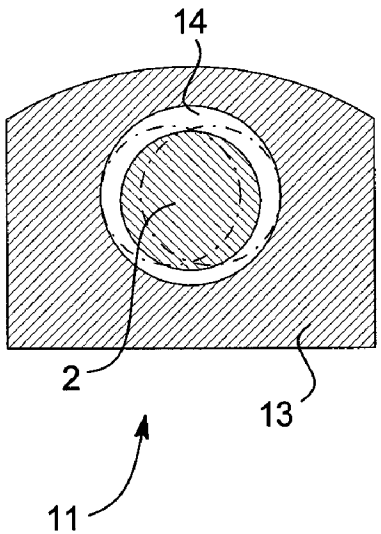
FIG. 2 is a sectional view taken along the line A-A of the embodiment shown in FIG. 1.
Figure 3:
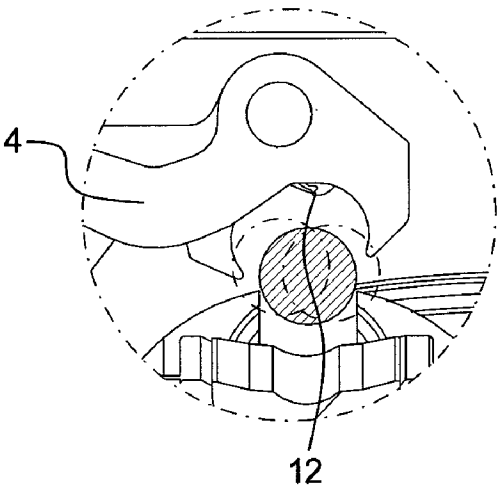
FIG. 3 is a sectional view taken along the line B-B of the embodiment shown in FIG. 1.
Figure 4:
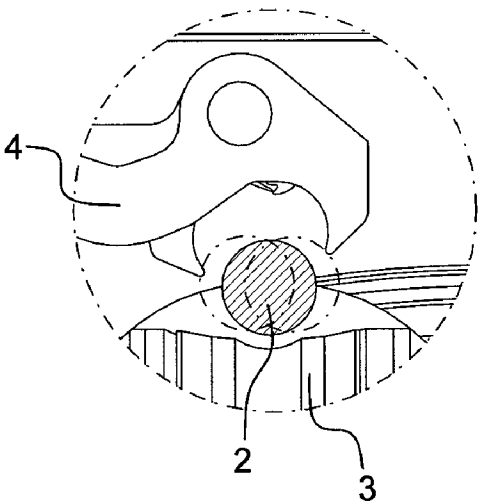
FIG. 4 is a sectional view taken along the line C-C of embodiment shown in FIG. 1.
Figure 5:
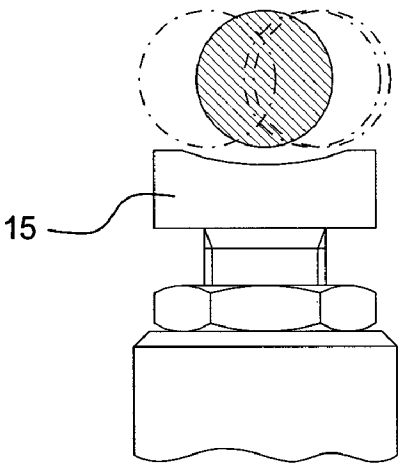
FIG. 5 is a sectional view taken along the line D-D of embodiment shown in FIG. 1.
Figure 6:
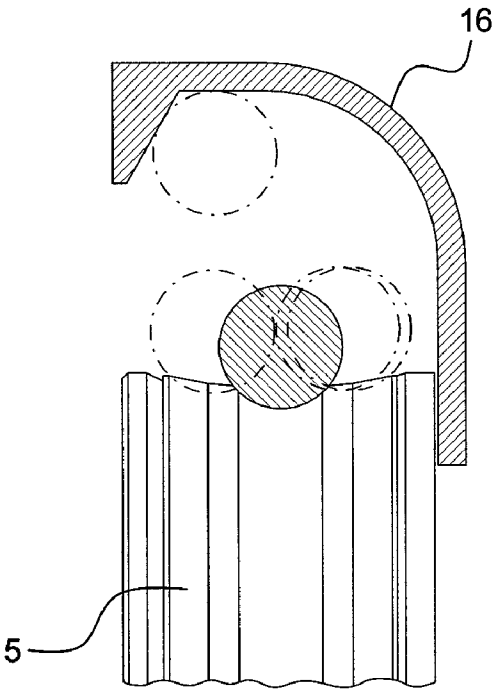
FIG. 6 is a sectional view taken along the line E-E of the embodiment shown in FIG. 1.

In accordance with the present invention there is provided before the coupling region of the clamp 4 at the cable 2, before the coupling rail, an aligning device 11 capable of limiting deflection of the cable 2 due to derailing at the roller battery 6 such that the cable 2 is now always located within the jaw opening 12 of the clamp. As evident from FIG. 2 the aligning device 11 is formed by a locator 13 in which a hole 14 is drilled having a diameter larger than the diameter of the cable 2 depending on the spacing away from the provided clamping position.

In one embodiment the aligning device 11 is assigned at least one cable capture locator 15 for locating the cable 2 to which the clamp 4 is already coupled. The cable capture locator 15 has a concave surface to align the cable 2 in the direction of the middle of the concavity.

In another embodiment there is provided, in addition to the first or at least just one of the rollers 3 supporting the cable 2 with the coupled clamp 4, an upper cable capture bracket 16 limiting the upwards deflection of the cable 2.

Expediently, the aligning device 11 is assigned an alert system which halts the cable car system as soon as the cable 2 comes into contact with the hole 14 but which while allowing attachment of the clamp halts the cable car system with the clamp already attached and thus without any risk of the driving means dropping out of place together with the passengers.

Figure 8:
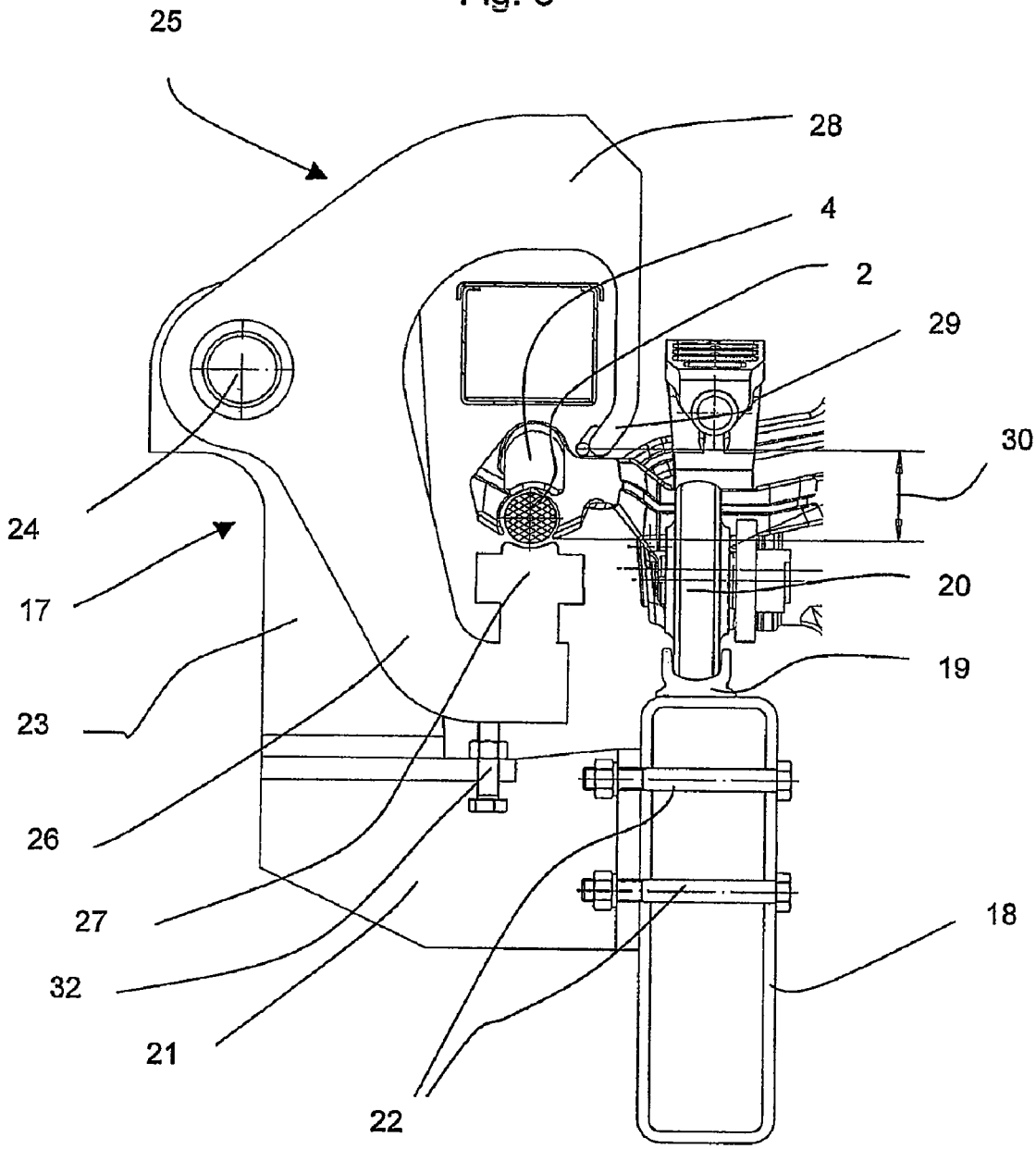
FIG. 8 is a front plan view of a forced guidance means of the system in accordance with the present invention.
Figure 9:
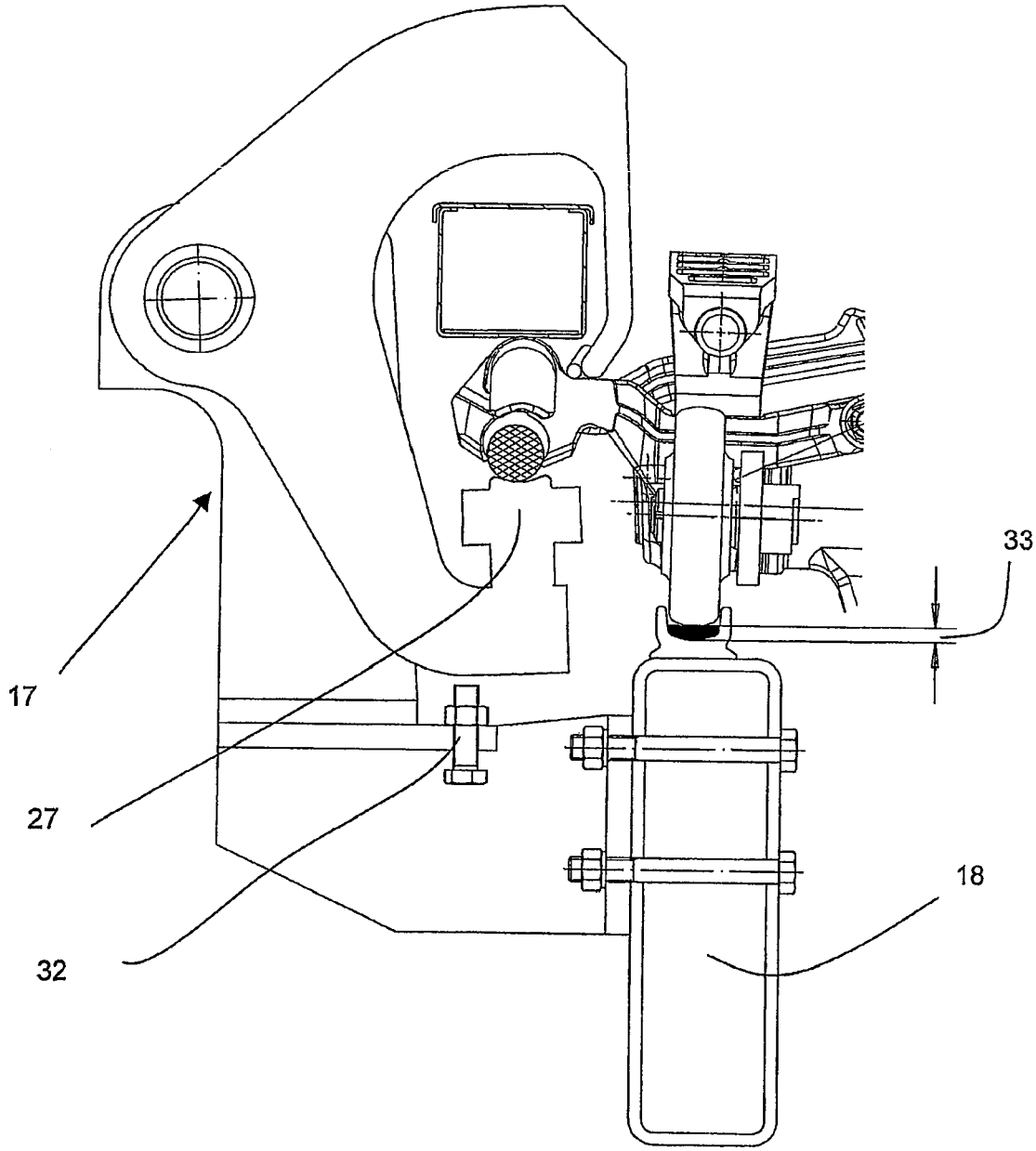
FIG. 9 is a front plan view of the forced guidance means of FIG. 8, but in a raised position due to snow accumulation or some other obstacle.
Figure 10:
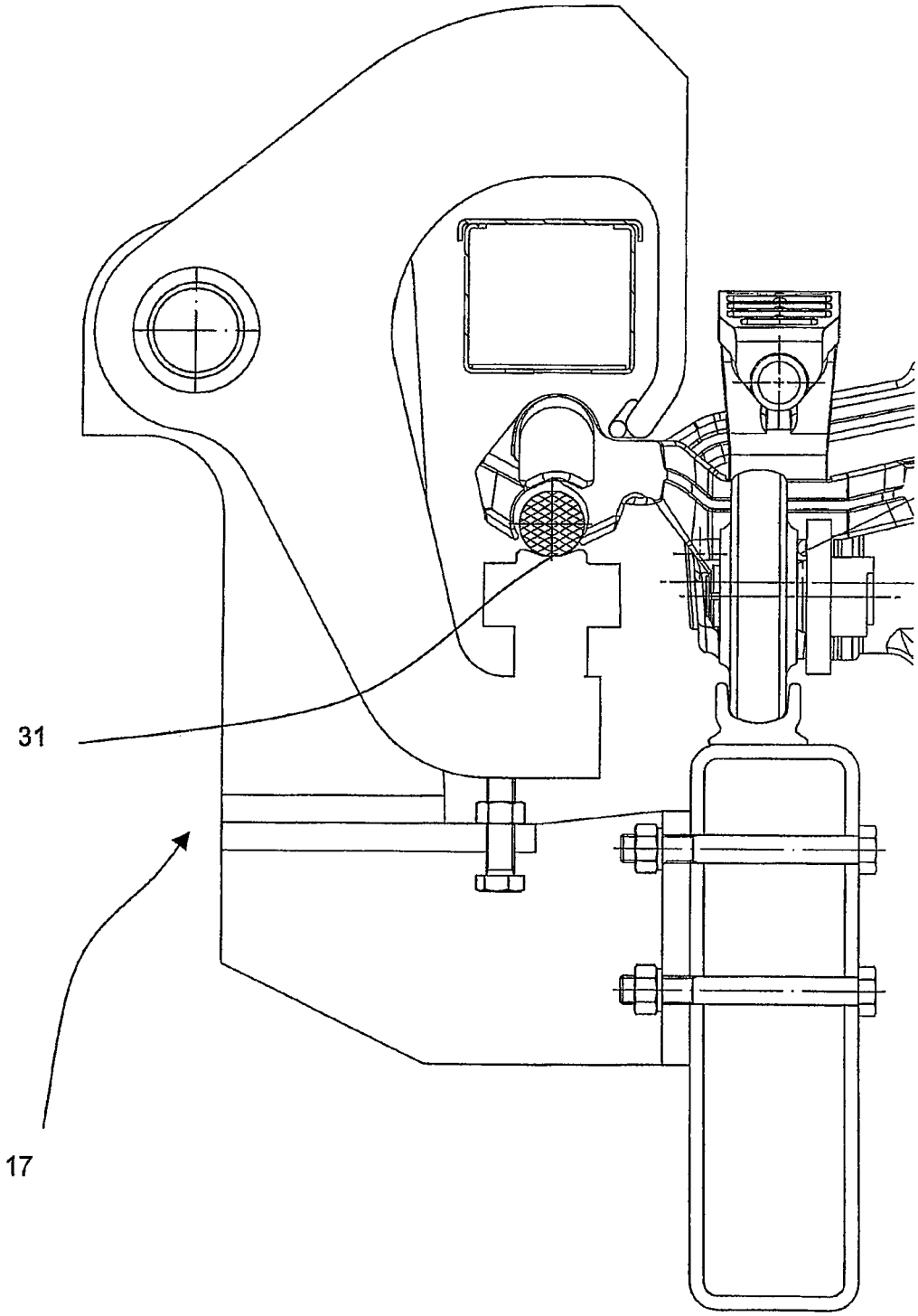
FIG. 10 is a front plan view of the forced guidance means of FIGS. 8 and 9, but in a position of maximum deflection of the cable relative to the clamp.

In the variant embodiment as shown in FIGS. 8, 9 and 10, instead of a locator 15, a forced guidance means 17 is provided attached to a supporting structure 18 of the coupling rail 19 of the supporting roller 20 of the clamp 2.

The forced guidance means 17 is attached by a bracket 21 secured by bolts 22 to the supporting structure 18. Extending upwards from the bracket 21 is a supporting yoke 23 to which a fork 25 is secured by an articulated link 24. The fork 25 comprises a lower arm 26, the free end of which is configured as a rest 27 for the cable 2. The fork is limited in rotation by a stop 32 coming up against the lower arm. In addition the fork 25 comprises an upper arm 28 ending in a boss 29 to come into contact with the body of the clamp 2.

Defined between the rest 27 and the boss 29 is an adjustable spacing 30 permitting passage of the clamp 4 and cable 2 as a whole with the cable 2 freely passing above the rest 27 when clamped in place which normally occurs between clamp and cable. When snow accumulates (33 in FIG. 9) the clamp is raised together with the fork 25, lifting the cable 2 at the rest 27 such that the clamp 4 still clasps the cable, whereas FIG. 10 depicts the maximum deflection 31 downwards when the fork 25 is stopped by the rest 27, making it clear that the clamp is thus designed to fully clamp the cable.

The invention claimed is:

1. A cable car system cable derailing prevention device comprising:

a hauling cable;

a clamp from which a transportation unit is suspended;

a plurality of rollers which flank a coupling rail and are located at an exit from a station, wherein at least a portion of the coupling rail defines a coupling area and the clamp is configured to couple with the hauling cable along the coupling area;

at least one support roller configured to support a portion of the hauling cable along the coupling area;

a roller battery associated with a cable guide; and a cable aligning device mounted upstream of the coupling area, wherein the cable aligning device is:

(i) formed by a locator defining a hole having a size larger than a diameter of the hauling cable, the size of the hole depending on a distance the cable aligning device is from a clamping area, and (ii) configured to limit a deviation of the cable due to a derailing of the hauling cable on the roller battery to provide that when the clamp is located in the coupling area, the hauling cable is always located inside a jaw opening of the clamp.

2. The cable derailing prevention device of claim 1, wherein the cable aligning device is associated with at least one hauling cable capture locator positioned downstream of the coupling area and configured to support the hauling cable.

3. The cable derailing prevention device of claim 2, wherein the hauling cable capture locator includes a concave surface which aligns the hauling cable in a direction of a center of the concave surface.

4. The cable derailing prevention device of claim 2, which includes at least one upper cable hauling capture bracket fitted to said at least one roller and configured to limit deflection of the hauling cable upwards.

5. A cable car system cable derailing prevention device comprising:

a hauling cable;

a clamp from which a transportation unit is suspended;

a plurality of rollers which flank a coupling rail and are located at an exit from a station, wherein at least a portion of the coupling rail defines a coupling area and the clamp is configured to couple with the hauling cable along the coupling area;

at least one support roller configured to support a portion of the hauling cable along the coupling area;

a roller battery associated with a cable guide;

a cable aligning device mounted upstream of the coupling area, wherein the cable aligning device is configured to limit a deviation of the cable due to a derailing of the hauling cable on the roller battery to provide that when the clamp is located in the coupling area, the hauling cable is always located inside a jaw opening of the clamp; and a fork pivotably connected to a supporting structure of the coupling rail via a bracket, the fork including a lower arm having a free end configured as a hauling cable rest and including an upper arm having a free end configured to come into contact with a body of the clamp, wherein an adjustable spacing is defined between the hauling cable rest and the free end of the upper arm to enable the clamp and the hauling cable as a whole to pass with the hauling cable freely passing above the hauling cable rest when the coupling between the clamp and the hauling cable occurs normally.

6. The cable derailing prevention device of claim 5, wherein the fork is limited in rotation by a stop coming up against the lower arm.

7. The cable derailing prevention device of claim 6, wherein the stop is adjustable.

8. A cable car system cable derailing prevention device comprising:

a body configured to pivotably connect to a support structure;

a lower arm connected to the body, said lower arm including a hauling cable engager; and an upper arm connected to the body, said upper arm having a transportation unit clam engager configured to guide a transportation unit clamp into a position to couple with a hauling cable, the hauling cable engager and the transportation unit clamp engager configured to define an adjustable space such that the hauling cable is free to pass above the hauling cable engager when the transportation unit clamp and the hauling cable are coupled.

9. The cable derailing prevention device of claim 8, which includes an adjustable lower arm rotation stop connectable to the support structure.

10. A cable car system cable derailing prevention device comprising:

a cable aligning device mounted upstream of a coupling area where a transportation unit clamp is configured to couple with a hauling cable, the cable aligning device being configured to limit a deviation of the hauling cable; and a cable attachment guide device including:

a body, a lower arm connected to the body, said lower arm including a hauling cable engager, and an upper arm connected to the body, said upper arm having a transportation unit clamp engager configured to guide the transportation unit clamp into a position to couple with the hauling cable, the hauling cable engager and the transportation unit clamp engager configured to define an adjustable space such that the hauling cable is free to pass above the hauling cable engager when the transportation unit clamp and the hauling cable are coupled.

11. The cable derailing prevention device of claim 10, wherein the body of the cable attachment device is configured to pivotably connect to a support structure.

12. The cable derailing prevention device of claim 11, which includes an adjustable lower arm rotation stop connectable to the support structure.

* * * * *